US009104222B2

(12) United States Patent
Pigott

(10) Patent No.: US 9,104,222 B2
(45) Date of Patent: Aug. 11, 2015

(54) LOW DROPOUT VOLTAGE REGULATOR WITH A FLOATING VOLTAGE REFERENCE

(75) Inventor: John M. Pigott, Phoenix, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 449 days.

(21) Appl. No.: 13/593,677

(22) Filed: Aug. 24, 2012

(65) Prior Publication Data

US 2014/0055112 A1 Feb. 27, 2014

(51) Int. Cl.
*G05F 1/613* (2006.01)
*G05F 1/575* (2006.01)

(52) U.S. Cl.
CPC ..... *G05F 1/575* (2013.01)

(58) Field of Classification Search
CPC ..... G05F 1/575; G05F 1/565; G05F 1/56
USPC ..... 323/231, 273–276, 279, 281
See application file for complete search history.

(56) References Cited

U.S. PATENT DOCUMENTS

| | | | | |
|---|---|---|---|---|
| 3,641,423 | A | 2/1972 | Stauffer | |
| 4,884,161 | A | 11/1989 | Atherton et al. | |
| 5,686,821 | A | 11/1997 | Brokaw | |
| 2009/0121694 | A1 * | 5/2009 | Wyatt | 323/275 |
| 2010/0327834 | A1 * | 12/2010 | Lowe, Jr. | 323/282 |

* cited by examiner

*Primary Examiner* — Gary L Laxton
*Assistant Examiner* — Afework Demisse
(74) *Attorney, Agent, or Firm* — Sherry W. Schumm

(57) ABSTRACT

An embodiment of a voltage regulator includes a pass device, a feedback circuit, and an operational amplifier (opamp). A first current conducting terminal of the opamp is coupled to an input voltage node, and a second current conducting terminal of the opamp is coupled to a regulated voltage node. The feedback circuit is coupled between the regulated voltage node and the feedback node, and the feedback circuit is a floating voltage reference configured to produce a feedback signal. The opamp has an input coupled to a feedback node, and an output coupled to a control terminal of the pass device. The opamp provides a signal to the control terminal based on the feedback signal from the feedback node. The control signal causes a current through the pass device to vary to maintain a voltage at the regulated voltage node at a target regulated voltage.

19 Claims, 3 Drawing Sheets

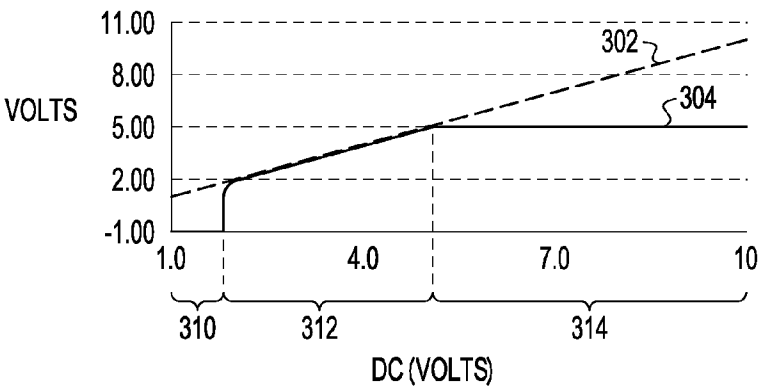
300 FIG. 3
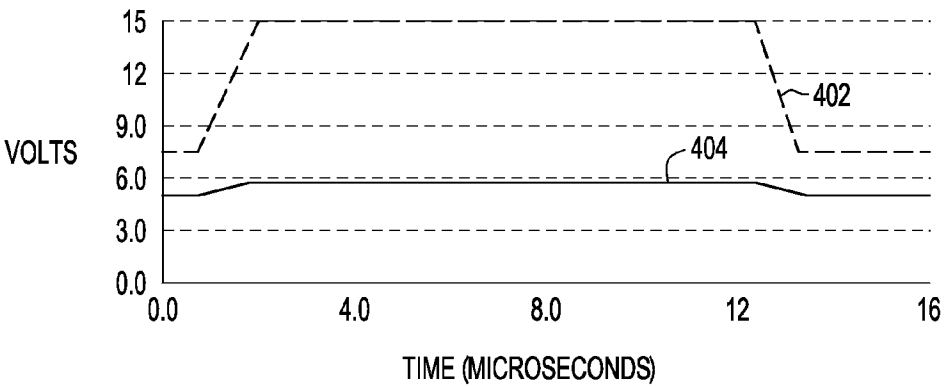
400 FIG. 4

LOW DROPOUT VOLTAGE REGULATOR WITH A FLOATING VOLTAGE REFERENCE

TECHNICAL FIELD

Embodiments of the subject matter described herein relate generally to voltage regulators, and more specifically to Low Dropout (LDO) voltage regulators.

BACKGROUND

Voltage regulators are commonly used to convert unregulated (e.g., potentially varying and noisy) input voltages to regulated (e.g., relatively stable and noise-free) output voltages. A Low Dropout (LDO) voltage regulator is a particular type of linear voltage regulator, which is used when it is desirable to minimize the voltage drop between the regulator's input and output terminals (e.g., to as little as a few hundred millivolts or less). For example, a typical LDO voltage regulator includes a pass transistor having first and second current carrying terminals coupled to an unregulated input voltage terminal and a regulated output voltage terminal, respectively. The difference between the voltage across the regulator's output terminals (or the "regulated" voltage) and a reference voltage (produced based on the input voltage) is used to control the pass transistor (i.e., via the pass transistor's control terminal) in order to maintain a desired regulated voltage. Higher gain in this feedback loop (referred to as "loop gain") enhances output voltage regulation accuracy, but makes maintaining system stability more difficult.

A load coupled across an LDO voltage regulator's output terminals may be characterized, for example, as a parallel combination of a variable load resistance and a variable load capacitance, where the load capacitance has a variable effective series resistance (ESR) associated with it. The variations in the load's resistance, capacitance, and ESR may result, for example, from any combination of temperature fluctuations, component variations, load configuration changes, and so on.

An LDO voltage regulator is capable of rapidly adjusting its output current (via modulation of the signal provided to the pass transistor) in the face of significant load variations to maintain a desired regulated voltage. However, the high open loop output impedance of a typical LDO voltage regulator makes the regulator's frequency stability particularly susceptible to such load variations, and absent appropriate compensation, the load variations may adversely affect the regulator's frequency stability. In modern circuits, a typical LDO voltage regulator may have many poles and zeros, and the feedback loops in such LDO voltage regulators may be very difficult to compensate.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

FIG. 3 is a plot of the DC response of an embodiment of a voltage regulator circuit; and FIG. 4 is a plot of the transient response of an embodiment of a voltage regulator circuit.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, or the following detailed description.

Embodiments of Low Dropout (LDO) voltage regulators include regulators in which the overall loop gain is reduced (when compared with conventional LDO voltage regulators) in order to enhance the stability of the LDO voltage regulator. Embodiments may be particularly well suited for applications in which there is a desire for a relatively simple, stable LDO voltage regulator that does not need to be highly accurate, and thus may have relatively low loop gain. An LDO voltage regulator according to an embodiment may be used, for example, as a pre-regulator, although it may be used for other purposes, as well.

Figure 1:
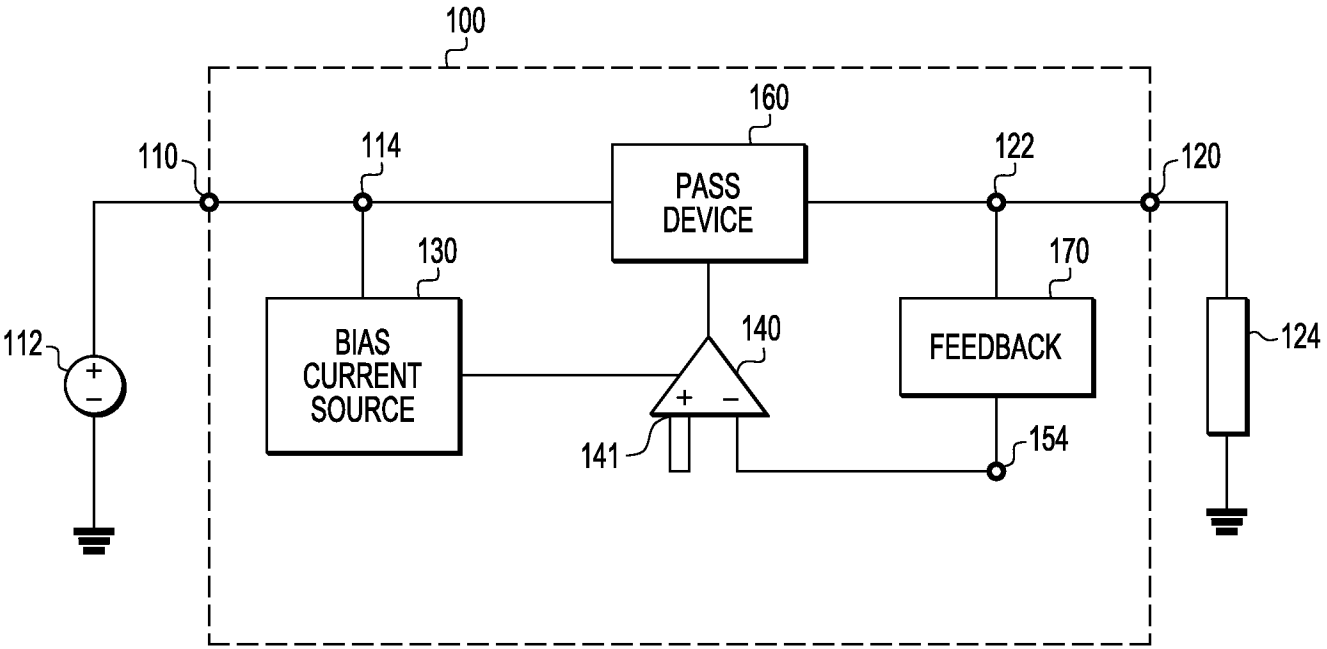
FIG. 1 is a simplified block diagram of a voltage regulator, in accordance with an example embodiment.
Figure 2:
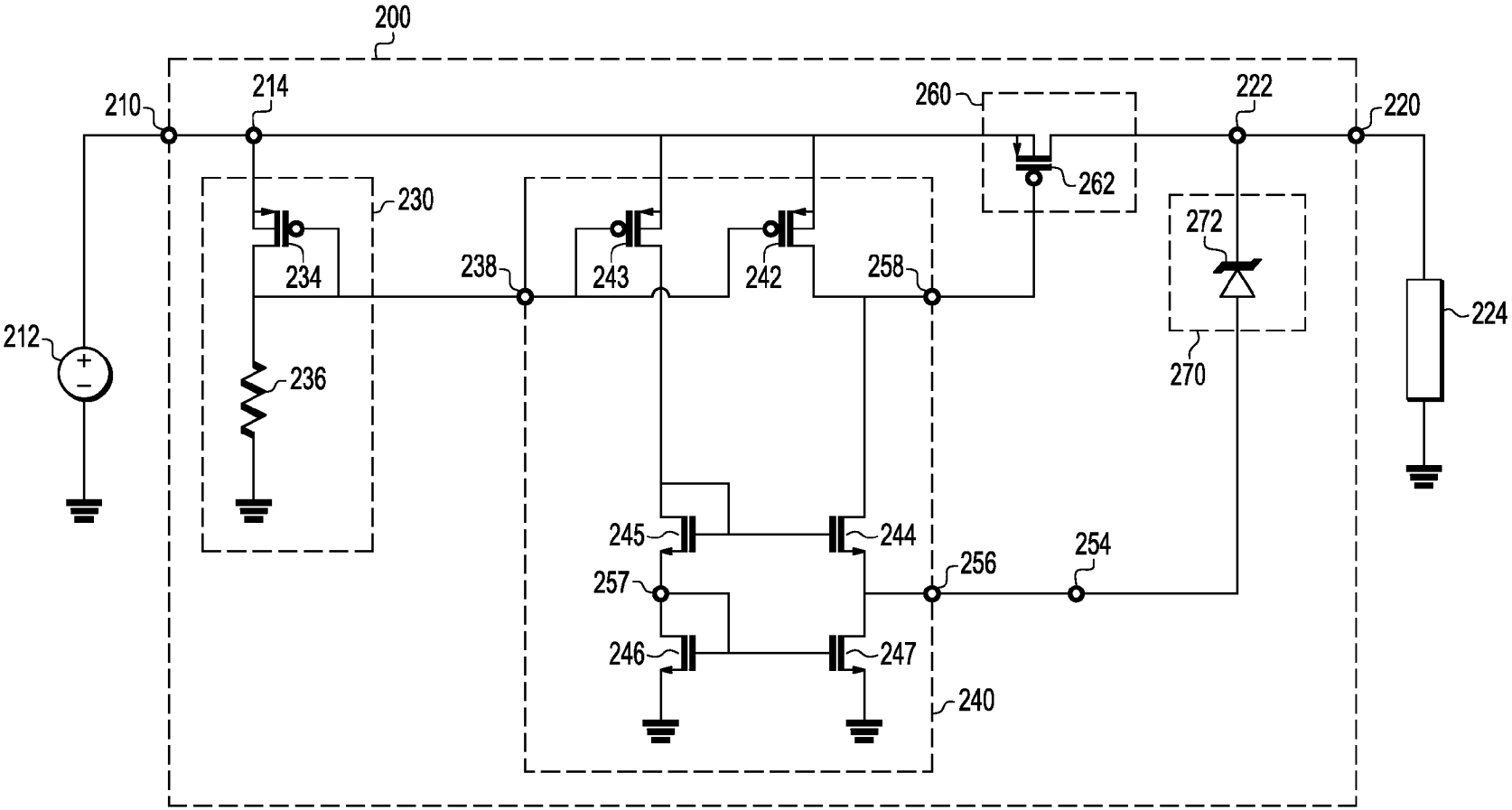
FIG. 2 is a schematic diagram of a voltage regulator circuit, in accordance with an example embodiment.

FIG. 1 is a simplified block diagram of a voltage regulator 100, in accordance with an example embodiment. Voltage regulator 100 includes input voltage terminal 110, output voltage terminal 120, bias current source 130, operational amplifier 140 ("opamp"), pass device 160, and feedback circuit 170, according to an embodiment. FIGS. 1 and 2 show various components and nodes that are coupled to a ground reference of the system. However, this is not to be limiting. Those of skill in the art would understand, based on the description herein, that the various components and nodes alternatively may be coupled to a reference having a voltage above or below a ground reference of the system. Accordingly, although the figures and description refer to a ground reference (or "ground"), the references are not meant to be limiting.

The input voltage terminal 110 is coupled between a voltage source 112 (e.g., a battery) and an input voltage node 114, and output voltage terminal 120 is coupled between a regulated voltage node 122 and a load 124. Pass device 160 has first and second current conducting terminals (e.g., a source and a drain, respectively), which are coupled to the input voltage node 114 and the regulated voltage node 122, respectively. The current between the current conducting terminals of pass device 160 is modulated based on a control signal provided by opamp 140 to a control terminal (e.g., a gate) of pass device 160. According to an embodiment, pass device 160 includes a P-type metal oxide semiconductor field effect transistor (PMOSFET), although other types of pass devices (or multi-component circuits) alternatively may be used. For example, pass device 160 may include an N-type MOSFET, a bipolar junction transistor (BJT), or another type of circuit or device having a current that may be modulated. Desirably, pass device 160 has an insignificant voltage drop between its input and output terminals (i.e., its current carrying terminals), so that the voltage on the output terminal may be arbitrarily close to the voltage on the input terminal, during certain modes of operation (e.g., the voltage at regulated voltage node 122 may approximately equal the voltage at input voltage node 114 while pass device 160 is operating within its linear region).

Bias current source 130 is coupled between the input voltage node 114 and a bias node of opamp 140, and bias current source 130 is configured to provide a bias current to opamp 140, as will be explained in more detail in conjunction with FIG. 2.

Opamp 140 has an external input (e.g., an inverting input), a reference node (e.g., corresponding to a non-inverting input), and an output. The external input is coupled to feedback circuit 170 via feedback node 154. According to an embodiment, opamp 140 internally generates a small offset voltage at the reference node, which is indicated in FIG. 1 by showing a conductive loop at the non-inverting input 141 of the opamp 140. In other words, the opamp 140 internally generates a reference voltage at the reference node (e.g., at non-inverting input 141), where the reference voltage is at ground or a small voltage above ground (i.e., the non-inverting input 141 is internally biased at ground or a small voltage above ground). The output of opamp 140 is coupled to the control terminal of pass device 160. According to an embodiment, opamp 140 is configured to amplify a difference between the voltages at the external input and reference node, in order to provide a control signal at the opamp output to pass device 160. The control signal controls the current between the current conducting terminals of pass device 160. More specifically, the control signal modulates the current through pass device 160 so that the voltage at the regulated voltage node 222 is maintained at a target regulated voltage.

Feedback circuit 170 is coupled between the regulated voltage node 122 and the feedback node 154. Feedback circuit 170 is configured to provide feedback for regulating (via opamp 140 and pass device 160) the output voltage at the regulated voltage node 122. Feedback circuit 170 may be characterized as a "floating voltage reference," in that the voltage produced by feedback circuit 170 at feedback node 154 is not referenced to ground, but instead could be characterized as being the voltage at node 170 minus a voltage reference value. According to an embodiment, feedback circuit 170 includes a diode (e.g., Zener diode 272, FIG. 2) with its anode coupled to the feedback node 154 and its cathode coupled to the regulated voltage node 122. In other embodiments, feedback circuit 170 may include multiple diodes (e.g., multiple Zener diodes) coupled in series, where "coupled in series" means that the anode of each diode in the series is coupled to the cathode of the next diode in the series. In an embodiment that includes multiple diodes coupled in series, the "anode" of the series refers to the anode of the diode (in the series) that is coupled to the feedback node 154, and the "cathode" of the series refers to the cathode of the diode (in the series) that is coupled to the regulated voltage node 122. In still other embodiments, feedback circuit 170 may include other circuitry capable of functioning as an appropriate floating voltage reference.

The regulated output voltage present at regulated voltage node 122 is set by the feedback circuit 170 and the offset voltage at the non-inverting input 141 of opamp 140. In other words, the regulated output voltage present at regulated voltage node 122 is set by a floating voltage reference, in an embodiment. Although the description herein, particularly in reference to FIG. 2, describes feedback circuit 170 as essentially consisting of a Zener diode, those of skill in the art would understand, based on the description herein, that feedback circuit 170 may include multiple Zener diodes (e.g., in series or other configurations), one or more other types of diodes (e.g., light emitting diodes or other diodes), and/or other circuits that provide the functionality of feedback circuit 170 described herein.

FIG. 2 is a schematic diagram of a voltage regulator circuit 200, in accordance with an example embodiment. Voltage regulator 200 includes input voltage terminal 210, output voltage terminal 220, bias current source 230, opamp 240, pass device 260, and feedback circuit 270, according to an embodiment. After describing embodiments of and interconnections between the various components of voltage regulator circuit 200, a detailed description of the operation of voltage regulator circuit 200 will then be discussed.

Input voltage terminal 210 is coupled between a voltage source 212 (e.g., a battery) and an input voltage node 214, and output voltage terminal 220 is coupled between a regulated voltage node 222 and a load 224. Pass device 260 has first and second current conducting terminals (e.g., a source and a drain, respectively), which are coupled to the input voltage node 214 and the regulated voltage node 222, respectively. The current between the current conducting terminals of pass device 260 is modulated based on a control signal provided by opamp 240 to a control terminal (e.g., a gate) of pass device 260. According to an embodiment, pass device 260 includes a PMOSFET. Thus, the magnitude of the current through pass device 260 generally is inversely related to the voltage of the control signal, when the gate-source voltage is below the threshold voltage of pass device 260 (i.e., while the pass device 260 is operating within its linear region). In other embodiments, other types of pass devices (or multi-component circuits) alternatively may be used.

Bias current source 230 is coupled between the input voltage node 214 and a bias input 238 of opamp 240. According to an embodiment, bias current source 230 is configured to provide a bias current to opamp 240 in order to effect operation of the opamp 240, as will be described in more detail later. More specifically, bias current source 230 biases particular transistors within opamp 240 (i.e., transistors 242, 243), which essentially function as current sources within opamp 240. Bias current source 230 includes a first transistor 234 and a resistor 236, coupled in series between the input voltage node 214 and ground, in an embodiment. For example, the first transistor 234 may be a PMOSFET having a first current conducting terminal (e.g., a source) coupled to the input voltage node 214 and a second current conducting terminal (e.g., a drain) coupled to a first terminal of resistor 236 and to the bias input 238 of opamp 240. A control terminal of the first transistor 234 is coupled to its second current conducting terminal, to the bias input 238, and to the first terminal of resistor 236. A second terminal of resistor 236 is coupled to ground.

According to an embodiment, opamp 240 includes the bias input 238, an external input 256 (e.g., an inverting input), a reference node 257 (e.g., an internal node corresponding to a non-inverting input), an output 258, and a plurality of transistors 242-247. As discussed previously, the bias input 238 is coupled to the bias current source 230. The external input 256 is coupled to feedback circuit 270 via feedback node 254. According to an embodiment, opamp 240 internally generates a small offset voltage at the reference node 257. The output 258 of opamp 240 is coupled to the control terminal (e.g., the gate) of pass device 260 (e.g., transistor 262). As will be described in more detail below, opamp 240 is configured to provide a control signal to pass device 260 based on a feedback signal from feedback circuit 270. The control signal functions to modulate the current between the current conducting terminals of pass device 260, and thus the control signal functions to control the regulated voltage present at regulated voltage node 222.

According to an embodiment, the plurality of transistors of opamp 240 includes a second transistor 242, a third transistor 243, a fourth transistor 244, a fifth transistor 245, a sixth transistor 246, and a seventh transistor 247. The second and third transistors 242, 243 are PMOSFETs, and the fourth, fifth, sixth, and seventh transistors 244-247 are NMOSFETs, in an embodiment, although different types of transistors or transistor combinations may be used, in other embodiments. The second transistor 242 includes: a first current conducting terminal (e.g., a source) coupled to the input voltage node 214; a second current conducting terminal (e.g., a drain) coupled to the output 258 of opamp 240 and to a current conducting terminal of the fourth transistor 244; and a control terminal (e.g., a gate) coupled to the bias current source 230 (via bias input 238) and to a control terminal of the third transistor 243. The third transistor 243 includes: a first current conducting terminal (e.g., a source) coupled to the input voltage node 214; a second current conducting terminal (e.g., a drain) coupled to current conducting and control terminals of the fifth transistor 245; and a control terminal (e.g., a gate) coupled to the bias current source 230 (via bias input 238) and to the control terminal of the second transistor 242. The fourth transistor 244 includes: a first current conducting terminal (e.g., a drain) coupled to the second current conducting terminal of the second transistor 242; a second current conducting terminal (e.g., a source) coupled to the external input 256 of opamp 240 (and thus to feedback node 254) and to a current conducting terminal of the seventh transistor 247; and a control terminal (e.g., a gate) coupled to current conducting and control terminals of the fifth transistor 245. The fifth transistor 245 includes: a first current conducting terminal (e.g., a drain) coupled to the second current conducting terminal of the third transistor 243; a second current conducting terminal (e.g., a source) coupled to the reference node 257, a current conducting terminal of the sixth transistor 246 and control terminals of the sixth and seventh transistors 246, 247; and a control terminal (e.g., a gate) coupled to the control terminal of the fourth transistor 244 and to its own, first current conducting terminal (i.e., the gate and drain of the fifth transistor 245 are coupled together). The sixth transistor 246 includes: a first current conducting terminal (e.g., a drain) coupled to the reference node 257 and to the second current conducting terminal of the fifth transistor 245; a second current conducting terminal (e.g., a source) coupled to ground; and a control terminal (e.g., a gate) coupled to the control terminal of the seventh transistor 247 and to its own, first current conducting terminal (i.e., the gate and drain of the sixth transistor 246 are coupled together). The seventh transistor 247 includes: a first current conducting terminal (e.g., a drain) coupled to the second current conducting terminal of the fourth transistor 244 and to the external input 256 of opamp 240 (and thus to feedback node 254); a second current conducting terminal (e.g., a source) coupled to ground; and a control terminal (e.g., a gate) coupled to current conducting and control terminals of the sixth transistor 246.

In an embodiment, the second and third transistors 242, 243 match in order to generate a same current, when appropriately biased. In addition, the fourth and fifth transistors 244, 245 may match in order not to generate an undesired offset. Similarly, the sixth and seventh transistors 246, 247 may match in order not to generate an undesired offset. In alternate embodiments, the above transistor pairs may not be matched. For example, in a particular alternate embodiment, sixth and seventh transistors 246, 247 deliberately may be mismatched to produce an offset voltage across them (e.g., the sixth transistor 246 may be slightly smaller than the seventh transistor 247). The mismatching may be performed to produce a slight offset voltage between the external input 256 and reference node 257, while still ensuring that the opamp 240 balances.

Feedback circuit 270 is coupled between the regulated voltage node 222 and the feedback node 254 (and thus the external input 256 to opamp 240). According to an embodiment, feedback circuit 270 includes at least one diode 272 (e.g., a Zener diode) with a first terminal (e.g., an anode) coupled to the feedback node 254 and a second terminal (e.g., a cathode) coupled to the regulated voltage node 222. As mentioned above, feedback circuit 270 provides feedback to opamp 240, which enables opamp 240 to regulate the output voltage at node 222 (via control inputs to pass device 260). As will become apparent from the description, below, feedback node 254 represents a low voltage, low impedance node during operation.

According to an embodiment, the regulated output voltage present at regulated voltage node 222 and output voltage terminal 220 is set by the feedback circuit 270 (e.g., by Zener diode 272). According to such an embodiment, feedback circuit 270 generally will conduct current between the regulated voltage node 222 and the feedback node 254 when the voltage across the first and second terminals meets or exceeds the reverse breakdown voltage of the Zener diode 272 (plus a small offset voltage at the non-inverting input 257 that functions to balance opamp 240). At and above the reverse breakdown voltage, the voltage regulator circuit 200 may be considered to be "in regulation," and the voltage at the regulated voltage node 222 will be limited approximately to the reverse breakdown voltage of the Zener diode 272. In other words, the target regulated voltage at the regulated voltage node 222 is set by the feedback circuit 270 (i.e., by the Zener diode 272).

According to an embodiment, feedback circuit 270 includes a single Zener diode 272, and the target regulated output voltage at the regulated voltage node 222 approximately equals the reverse breakdown voltage of Zener diode 272 plus the voltage at external input 256, which may be relatively small (e.g., up to about 300 millivolts, more or less). In an embodiment in which Zener diode 272 has a reverse breakdown voltage of 5.0 volts, for example, the target regulated voltage at the regulated voltage node 222 is slightly higher than 5.0 volts. In an alternate embodiment, feedback circuit 270 may include a single diode with a lower or higher reverse breakdown voltage, and/or feedback circuit 270 may include multiple diodes coupled in series to provide a target regulated voltage at regulated voltage node 222 that approximately equals the sum of the reverse breakdown voltages of the series-coupled diodes. For example, in an alternate embodiment in which feedback circuit 270 includes two Zener diodes coupled in series, each with a reverse breakdown voltage of about 5.0 volts, the target regulated voltage at node 222 would equal to approximately 10 volts.

The operation of voltage regulation circuit 200 will now be described with reference to both FIG. 2 and FIG. 3, which is a plot 300 of the direct current (DC) response of an embodiment of a voltage regulator (e.g., an embodiment of voltage regulator 100, 200, FIGS. 1, 2). In FIG. 3, the vertical axis represents the input voltage (for input voltage trace 302) or the output voltage (for regulated voltage trace 304) to the voltage regulation circuit 200, and the horizontal axis represents the input DC voltage applied at the regulator input 210. Trace 302 plots the input voltage to the voltage regulator (e.g., at input voltage terminal 210, FIG. 2), and trace 304 plots the DC value of the output voltage of the voltage regulator (e.g., at output voltage terminal 220, FIG. 2). Referring to both FIGS. 2 and 3, voltage regulation circuit 200 has at least three distinct regions of operation, and the region in which the voltage regulation circuit 200 is operating depends primarily on the magnitude of the input voltage 302 (e.g., at input voltage terminal 210). For example, voltage regulation circuit 200 may be in a low-output operational region 310 when the input voltage 302 is below a first input voltage threshold (e.g., less than about 1.9 volts in FIG. 3), a linear operational region 312 when the input voltage 302 is between the first input voltage threshold and a higher, regulation-triggering voltage threshold (e.g., about 5.0 volts for a feedback circuit 270 that includes a Zener diode 272 having a 5.0 volt reverse breakdown voltage), and a regulated operational region 314 when the input voltage 302 is above the regulation-triggering voltage threshold (e.g., above about 5.0 volts for the above-given example). When the input voltage 302 is below the regulation-triggering voltage threshold, the output voltage is not considered to be "in regulation," and when the input voltage 302 is above the regulation-triggering voltage threshold, the output voltage is considered to be "in regulation."

Operation of the voltage regulator circuit 200 within the low-output, linear, and regulated operational regions 310, 312, 314 will now be described. In the low-output operational region 310 (e.g., when the voltage at input voltage node 214 is below about 1.9 volts in FIG. 3), the opamp 240 is unable to control the pass transistor 262 to be "on," thus passing little or no current between its current conducting terminals (e.g., there is not sufficient voltage applied at input 210 to enable the opamp 240 to turn on the pass transistor 262, causing the pass transistor 262 to be unable to conduct significant current).

In the linear operational region 312 (e.g., when the voltage at input voltage node 214 is between about 1.9 volts and 5.0 volts in FIG. 3), opamp 240 controls the pass transistor 262 to be fully "on," and the pass transistor 262 conducts sufficient current to keep the output voltage at node 222 close to the input voltage at node 210. The resulting voltage at the regulated voltage node 222 is insufficient to cause the Zener diode 272 to conduct significant current (i.e., the Zener diode 272 is "off").

In the regulated operational region 314 (e.g., when the voltage at input voltage node 214 is above about 5.0 volts in FIG. 3), opamp 240 continues to control the pass transistor 262 to be "on." However, based on the feedback from feedback circuit 270, opamp 240 modulates the value of the output voltage at node 258 to control pass transistor 262 to ensure that the voltage at regulated voltage node 222 is maintained at the target regulated voltage (e.g., approximately the reverse breakdown voltage of Zener diode 272 plus the relatively small voltage at external input 256). More particularly, when the voltage at input voltage node 214 transitions above the regulation-triggering voltage threshold, the voltage at the regulated voltage node 222 rises above the reverse breakdown voltage of Zener diode 272, causing the Zener diode 272 to conduct current (i.e., the Zener diode 272 is "on"). Consequently, the voltage at feedback node 254 and external input 256 increases, and fourth transistor 244 begins to conduct less current. This, in turn, causes the voltage at output node 258 to increase, and the pass transistor 262 is thus controlled to conduct less current. The voltage at the regulated voltage node 222 is thus maintained at the target regulated voltage. If the input voltage at input voltage node 214 continues to rise, the pass transistor 262 is controlled to conduct even less current in order to keep the regulated output voltage from rising. As the voltage at the regulated voltage node 222 varies around the target regulated voltage, the opamp 240 modulates its control of the pass transistor 262 so that the target regulated voltage is maintained at the regulated voltage node 222 and the output voltage node 220.

FIG. 4 is a plot 400 of the transient (time) response of an embodiment of a voltage regulator circuit (e.g., an embodiment of voltage regulator 100, 200, FIGS. 1, 2). In FIG. 4, the vertical axis represents the input voltage (for input voltage trace 402) or the output voltage (for regulated voltage trace 404) to the voltage regulation circuit 200, and the horizontal axis indicates time. Trace 402 plots the input voltage to the voltage regulator (e.g., at input voltage terminal 210, FIG. 2), and trace 404 plots the regulated output voltage of the voltage regulator (e.g., at output voltage terminal 220, FIG. 2). During the time period represented in FIG. 4, the output voltage is in regulation. As can be seen, when the input voltage 402 increases abruptly from about 7.0 volts to about 15.0 volts, the regulated output voltage 404 increases only slightly and stabilizes. Similarly, when the input voltage 402 decreases abruptly from about 15.0 volts to about 7.0 volts, the regulated output voltage 404 decreases only slightly and again stabilizes.

Referring again to FIG. 2, and as mentioned previously, the target regulated output voltage (e.g., at the regulated voltage node 222) approximately equals the reverse breakdown voltage of a Zener diode (e.g., Zener diode 272) plus a relatively small voltage associated with the opamp (e.g., a voltage at the external input 256 to opamp 240). As the input voltage increases, the relatively small voltage associated with the opamp may increase slightly, as is represented by trace 404 of the regulated output voltage. More specifically, the regulated output voltage is given by the reverse breakdown voltage of Zener diode 272 plus the voltage that it takes to make external input 256 balance reference node 257. This value is set by the voltage at reference node 257, which equals the gate-source voltage (Vgs) of transistor 246 plus the difference in gate-source voltages between transistors 245 and 244. Accordingly, the regulated output voltage approximately equals the reverse breakdown voltage of Zener diode 272 plus the Vgs of transistor 246 plus the Vgs of transistor 245 minus the Vgs of transistor 244, in an embodiment. The Vgs of transistor 244 may change slightly (e.g., in the range of 100 millivolts or so) as the input voltage changes due to variations in the reference current or in its drain-source voltage. Thus, the regulated output voltage also may change slightly. However, for many applications, the relatively minor variations in the regulated output voltage are not of concern.

Embodiments of LDO voltage regulators discussed herein (e.g., LDO voltage regulators 100, 200, FIGS. 1, 2) may be formed as a portion of a single integrated circuit (i.e., the LDO regulator is monolithic). Alternatively, some components may be discrete (e.g., pass transistor 262 and/or Zener diode 272). In addition, embodiments of LDO voltage regulators discussed herein may be incorporated into higher-level systems, in order to provide certain functionality. For example, but not by way of limitation, an embodiment of an LDO voltage regulator may be used to bias other analog circuits in an integrated circuit (e.g., circuits run from a 5.0 volt supply). Alternatively, an embodiment of an LDO voltage regulator may be used as a pre-supply to another regulator. Embodiments LDO voltage regulators may be used for any of a number of other purposes, as well.

Embodiments of LDO voltage regulators discussed herein may have certain advantages over conventional LDO voltage regulators. For example, the LDO voltage regulator embodiments have a relatively low loop gain, and may include only one dominant pole. More specifically, for example, the single dominant pole (or the single high impedance node of opamp 240) corresponds to output 258, in an embodiment (e.g., output 258 is the only high impedance point in the feedback loop). Accordingly, stabilization of the LDO voltage regulator embodiments may be relatively easily achieved, and the load response may be improved, when compared with conventional LDO voltage regulators.

An embodiment of a voltage regulator includes an input voltage node configured to receive an input voltage, a regulated voltage node configured to convey an output voltage, a feedback node configured to convey a feedback signal, a pass device, a feedback circuit, and an operational amplifier (opamp). The pass device has a first current conducting terminal, a second current conducting terminal, and a control terminal. The first current conducting terminal is coupled to the input voltage node, and the second current conducting terminal is coupled to the regulated voltage node. The feedback circuit is coupled between the regulated voltage node and the feedback node, and the feedback circuit is a floating voltage reference configured to produce the feedback signal. The opamp has an input coupled to the feedback node, and an output coupled to the control terminal of the pass device. The opamp is configured to provide a signal to the control terminal based on the feedback signal from the feedback node. The control signal causes a current through the pass device to vary in order to maintain a voltage at the regulated voltage node at a target regulated voltage.

Another embodiment of a voltage regulator includes an input voltage node configured to receive an input voltage, a regulated voltage node configured to convey an output voltage, a feedback node configured to convey a feedback signal, a pass device, a feedback circuit, and an opamp. The pass device has a first current conducting terminal, a second current conducting terminal, and a control terminal. The first current conducting terminal is coupled to the input voltage node, and the second current conducting terminal is coupled to the regulated voltage node. The feedback circuit is coupled between the regulated voltage node and the feedback node.

The feedback circuit includes a diode reference that sets a target regulated voltage, and the feedback circuit produces the feedback signal. The opamp has an input coupled to the feedback node, and an output coupled to the control terminal of the pass device. The opamp is configured to provide a signal to the control terminal based on the feedback signal from the feedback node. The control signal causes a current through the pass device to vary in order to maintain a voltage at the regulated voltage node at the target regulated voltage.

Another embodiment of a voltage regulator includes a single-pass PMOSFET as a pass device (e.g., PMOSFET 262), with a Zener diode reference (e.g., Zener diode 272) to a low-voltage, low-impedance point in a feedback loop (e.g., external input 256), in order to regulate an output voltage (e.g., at regulated output voltage node 222). In other words, the regulated output voltage is essentially set by the Zener diode reference.

The connecting lines shown in the various figures contained herein are intended to represent exemplary functional relationships and/or physical couplings between the various elements. It should be noted that many alternative or additional functional relationships or physical connections may be present in an embodiment of the subject matter. In addition, certain terminology may also be used herein for the purpose of reference only, and thus are not intended to be limiting, and the terms "first", "second" and other such numerical terms referring to structures do not imply a sequence or order unless clearly indicated by the context.

As used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common node).

The foregoing description refers to elements or nodes or features being "connected" or "coupled" together. As used herein, unless expressly stated otherwise, "connected" means that one element is directly joined to (or directly communicates with) another element, and not necessarily mechanically. Likewise, unless expressly stated otherwise, "coupled" means that one element is directly or indirectly joined to (or directly or indirectly communicates with) another element, and not necessarily mechanically. Thus, although the schematic shown in the figures depict one exemplary arrangement of elements, additional intervening elements, devices, features, or components may be present in an embodiment of the depicted subject matter.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A voltage regulator comprising:

an input voltage node configured to receive an input voltage;

a regulated voltage node configured to convey an output voltage;

a feedback node configured to convey a feedback signal;

a pass device having a first current conducting terminal, a second current conducting terminal, and a control terminal, wherein the first current conducting terminal is coupled to the input voltage node, and the second current conducting terminal is coupled to the regulated voltage node;

a feedback circuit coupled between the regulated voltage node and the feedback node, wherein the feedback circuit is a floating voltage reference configured to produce the feedback signal, wherein the feedback circuit comprises one or more diodes, coupled in series when the one or more diodes include multiple diodes, and having a cathode coupled only to the regulated voltage node, and an anode coupled only to the feedback node, and wherein the target regulated voltage approximately equals a reverse breakdown voltage of the one or more diodes; and an operational amplifier having an input coupled to the feedback node, and an output coupled to the control terminal of the pass device, wherein the operational amplifier is configured to provide a signal to the control terminal based on the feedback signal from the feedback node, and wherein the control signal causes a current through the pass device to vary in order to maintain a voltage at the regulated voltage node at a target regulated voltage.

2. The voltage regulator of claim 1, wherein the pass device comprises a P-type metal oxide semiconductor field effect transistor.

3. The voltage regulator of claim 1, wherein the feedback circuit comprises one or more Zener diodes, coupled in series when the one or more Zener diodes include multiple Zener diodes, and having a cathode coupled to the regulated voltage node, and an anode coupled to the feedback node, and wherein the target regulated voltage approximately equals a reverse breakdown voltage of the one or more Zener diodes.

4. The voltage regulator of claim 3, wherein the operational amplifier has a single high impedance node corresponding to the output of the operational amplifier.

5. The voltage regulator of claim 3, wherein the operational amplifier internally generates a reference voltage at a reference node corresponding to a non-inverting input of the operation amplifier, wherein the reference voltage is at ground or a small voltage above ground.

6. The voltage regulator of claim 1, wherein the feedback circuit comprises multiple diodes coupled in series, and wherein the target regulated voltage approximately equals a sum of reverse breakdown voltages of the multiple diodes.

7. A voltage regulator comprising:

an input voltage node configured to receive an input voltage;

a regulated voltage node configured to convey an output voltage;

a feedback node configured to convey a feedback signal;

a pass device having a first current conducting terminal, a second current conducting terminal, and a control terminal, wherein the first current conducting terminal is coupled to the input voltage node, and the second current conducting terminal is coupled to the regulated voltage node;

a feedback circuit coupled between the regulated voltage node and the feedback node, wherein the feedback circuit is a floating voltage reference configured to produce the feedback signal; and an operational amplifier having an input coupled to the feedback node, and an output coupled to the control terminal of the pass device, wherein the operational amplifier is configured to provide a signal to the control terminal based on the feedback signal from the feedback node, and wherein the control signal causes a current through the pass device to vary in order to maintain a voltage at the regulated voltage node at a target regulated voltage, wherein the operational amplifier comprises:

a first transistor having a source coupled to the input voltage node, a drain coupled to the output of the operational amplifier, and a gate coupled to a bias current source;

a second transistor having a source coupled to the input voltage node, a drain, and a gate coupled to the bias current source and to the gate of the first transistor;

a third transistor having a drain coupled to the drain of the first transistor, a source coupled to the input of the operational amplifier, and a gate;

a fourth transistor having a drain coupled to the drain of the second transistor, a source coupled to a reference node, and a gate coupled to the gate of the third transistor and to the drain of the fourth transistor;

a fifth transistor having a drain coupled to the reference node, a source coupled to ground, and a gate coupled to the reference node; and a sixth transistor having a drain coupled to the drain of the third transistor and to the input of the operational amplifier, a source coupled to ground, and a gate coupled to the gate of the fifth transistor.

8. The voltage regulator of claim 7, wherein the first and second transistors are P-type metal oxide semiconductor field effect transistors, and the third, fourth, fifth, and sixth transistors are N-type metal oxide semiconductor field effect transistors.

9. A voltage regulator comprising:

an input voltage node configured to receive an input voltage;

a regulated voltage node configured to convey an output voltage;

a feedback node configured to convey a feedback signal;

a pass device having a first current conducting terminal, a second current conducting terminal, and a control terminal, wherein the first current conducting terminal is coupled to the input voltage node, and the second current conducting terminal is coupled to the regulated voltage node;

a feedback circuit coupled between the regulated voltage node and the feedback node, wherein the feedback circuit is a floating voltage reference configured to produce the feedback signal;

an operational amplifier having an input coupled to the feedback node, and an output coupled to the control terminal of the pass device, wherein the operational amplifier is configured to provide a signal to the control terminal based on the feedback signal from the feedback node, and wherein the control signal causes a current through the pass device to vary in order to maintain a voltage at the regulated voltage node at a target regulated voltage; and a bias current source configured to provide a bias signal to a bias input of the operational amplifier, wherein the bias signal causes the operational amplifier to place the pass device in a conductive state when the input voltage exceeds a first threshold.

10. The voltage regulator of claim 9, wherein the bias current source comprises:

a transistor having a source coupled to the input voltage node, and a drain and a gate coupled to the bias input; and a resistor coupled between the bias input and ground.

11. A voltage regulator comprising:

an input voltage node configured to receive an input voltage;

a regulated voltage node configured to convey an output voltage;

a feedback node configured to convey a feedback signal;

a pass device having a first current conducting terminal, a second current conducting terminal, and a control terminal, wherein the first current conducting terminal is coupled to the input voltage node, and the second current conducting terminal is coupled to the regulated voltage node;

a feedback circuit coupled between the regulated voltage node and the feedback node, wherein the feedback circuit includes a diode reference that sets a target regulated voltage, and the feedback circuit produces the feedback signal;

an operational amplifier having an input coupled to the feedback node, and an output coupled to the control terminal of the pass device, wherein the operational amplifier is configured to provide a signal to the control terminal based on the feedback signal from the feedback node, and wherein the control signal causes a current through the pass device to vary in order to maintain a voltage at the regulated voltage node at the target regulated voltage; and a bias current source configured to provide a bias signal to a bias input of the operational amplifier, wherein the bias signal causes the operational amplifier to place the pass device in a conductive state when the input voltage exceeds a first threshold.

12. The voltage regulator of claim 11, wherein the pass device comprises a P-type metal oxide semiconductor field effect transistor.

13. The voltage regulator of claim 11, wherein the feedback circuit comprises a diode having a cathode coupled to the regulated voltage node, and an anode coupled to the feedback node, and wherein the target regulated voltage approximately equals a reverse breakdown voltage of the diode.

14. The voltage regulator of claim 13, wherein the diode comprises a Zener diode.

15. The voltage regulator of claim 11, wherein the feedback circuit comprises multiple diodes coupled in series, and wherein the target regulated voltage approximately equals a sum of reverse breakdown voltages of the multiple diodes.

16. The voltage regulator of claim 11, wherein the operational amplifier internally generates a reference voltage at a reference node corresponding to a non-inverting input of the operation amplifier, wherein the reference voltage is at ground or a small voltage above ground.

17. The voltage regulator of claim 11, wherein the operational amplifier comprises:

a first transistor having a source coupled to the input voltage node, a drain coupled to the output of the operational amplifier, and a gate coupled to a bias current source;

a second transistor having a source coupled to the input voltage node, a drain, and a gate coupled to the bias current source and to the gate of the first transistor;

a third transistor having a drain coupled to the drain of the first transistor, a source coupled to the input of the operational amplifier, and a gate;

a fourth transistor having a drain coupled to the drain of the second transistor, a source coupled to a reference node, and a gate coupled to the gate of the third transistor and to the drain of the fourth transistor;

a fifth transistor having a drain coupled to the reference node, a source coupled to ground, and a gate coupled to the reference node; and a sixth transistor having a drain coupled to the drain of the third transistor and to the input of the operational amplifier, a source coupled to ground, and a gate coupled to the gate of the fifth transistor.

18. The voltage regulator of claim 17, wherein the first and second transistors are P-type metal oxide semiconductor field effect transistors, and the third, fourth, fifth, and sixth transistors are N-type metal oxide semiconductor field effect transistors.

19. The voltage regulator of claim 11, wherein the bias current source comprises:

a transistor having a source coupled to the input voltage node, and a drain and a gate coupled to the bias input; and a resistor coupled between the bias input and ground.

* * * * *